US006453620B1

(12) United States Patent
Williams et al.

(10) Patent No.: US 6,453,620 B1
(45) Date of Patent: Sep. 24, 2002

(54) WINDOW BUCK

(76) Inventors: Michael J. Williams, 3080 NW. Euston La., Redmond, OR (US) 97756; Mark S. Schneider, 9415 Sundown Canyon Rd., Terrebonne, OR (US) 97760

( * ) Notice: Subject to any disclaimer, the term of this patent is extended or adjusted under 35 U.S.C. 154(b) by 0 days.

(21) Appl. No.: 09/655,802

(22) Filed: Sep. 6, 2000

(51) Int. Cl.[7] ..... E06B 1/04

(52) U.S. Cl. ..... 52/2.15; 52/656.5; 52/576; 52/656.9; 52/209; 52/208; 249/39; 249/35; 249/177; 249/142

(58) Field of Search ..... 52/215, 217, 576

(56) References Cited

U.S. PATENT DOCUMENTS

| | | | | |
|---|---|---|---|---|
| 2,893,235 A | | 7/1959 | Goldberg | |
| 2,901,810 A | * | 9/1959 | Richards | 25/131 |
| 3,443,346 A | | 5/1969 | Eggert, Jr. | |
| 3,995,843 A | | 12/1976 | Kasteler | |
| 4,430,831 A | | 2/1984 | Kemp | |
| 4,589,624 A | | 5/1986 | Jones | 249/177 |
| 4,756,135 A | | 7/1988 | Citrullo et al. | |
| 4,831,804 A | | 5/1989 | Sayer | 52/475 |
| 4,944,118 A | | 7/1990 | Biro | |
| 5,090,168 A | | 2/1992 | Fast et al. | |
| 5,095,672 A | | 3/1992 | Tanikawa | |
| 5,169,544 A | | 12/1992 | Stanfill et al. | |
| 5,233,802 A | * | 8/1993 | Rogers | 52/212 |
| 5,239,797 A | | 8/1993 | Oldendorf | |
| 5,444,947 A | | 8/1995 | Miller | 52/100 |
| 5,522,196 A | | 6/1996 | Conroy et al. | |
| 5,746,033 A | * | 5/1998 | Chuang | 52/213 |
| 5,791,103 A | * | 8/1998 | Coolman et al. | 52/215 |
| 5,881,510 A | | 3/1999 | Ole | |
| 5,996,293 A | * | 12/1999 | Anderson et al. | 52/215 |
| 6,070,375 A | * | 6/2000 | Anderson et al. | 52/204.54 |
| 6,185,884 B1 | * | 2/2001 | Myers et al. | 52/215 |

* cited by examiner

*Primary Examiner*—Carl D. Friedman
*Assistant Examiner*—Basil Katchenes
(74) *Attorney, Agent, or Firm*—Kolisch, Hartwell, Dickinson, McCormack & Heuser, PC

(57) ABSTRACT

A window buck having members forming a frame with the members including adjustable components enabling use of the buck in walls under construction of different thicknesses. Extruded front and rear components of each buck member are adjustably interengaged with one another and fixable in a desired relationship to suit the wall being constructed. External channels formed in the buck members are open lengthwise to permit reception of angular connectors for joining the buck members at their intersecting ends. The connectors may be of reusable rebar and removable upon completion of the wall. The components of each buck member are lockable by inserted fasteners. A modified window buck includes a central component for use in walls of extraordinary thicknesses. A further modified window buck may include buck members of unitary construction.

45 Claims, 3 Drawing Sheets

WINDOW BUCK

BACKGROUND OF THE INVENTION

The present invention concerns window buck construction ultimately used as a form to define an opening in a cast wall for subsequent installation of a window.

Window bucks are commonly used in the construction of buildings of concrete wall construction and serve to block out an area in the wall during pouring of concrete. The window buck is supported in place on front and rear wall surfaces and left in place to receive a window assembly.

Homes and other buildings utilizing concrete as the major wall component may include inner and outer surfaces of insulative sheet material applied to reinforcing steel prior to pouring of the concrete to become an integral part of the wall. The insulative sheet material may serve as a wall form with the insulative qualities of the foam material U.S. Pat. No. 5,996,293 discloses a window buck for blocking out a wall area for later reception of a window. Elongate buck members are joined at their ends, in one form, by right angular locking members, each having a protruding frictional member for retention of an arm of the locking member within a selected interior channel of a buck member. The buck members define multiple internal channels. To retain the buck in assembled configuration the locking members must be of precise shape and size and become a part of the installed buck. A preferred form of the window buck disclosed dispenses with the right angular insertable locking members and achieves interlocking of the buck member ends by the cutting of the ends of the members to form tongues for insertion within slots cut in the intersecting end of an adjacent buck member. In both forms of the window buck disclosed no provision made for use of the window buck in the formation of window openings in walls of other than a single specified thickness. Further, the channels within which right angular connectors are inserted are all internal channels open only at their ends.

U.S. Pat. No. 5,791,103 discloses a window buck having members formed with internal channels extending along each side of the member and along a central wall of the member to receive inserts of right angular shape for joining intersecting ends of two buck members.

U.S. Pat. No. 4,831,804 discloses a plastic window frame wherein right angular gussets serve as locking members to join horizontal and vertical frame members by insertion into interior channels of corresponding cross section. The gussets and an overlapping stiffener in each buck member fit within a partially open internal channel defined by each buck member.

The provision of a buck being laterally adjustable to accommodate installation in walls of two predetermined thicknesses is disclosed in U.S. Pat. No. 4,589,624. The buck disclosed is adjustable to accommodate 8 inch or 9 inch thick walls. A clamp is secured in one of two positions by a key inserted through aligned slots in the clamp and a lip on two adjustable buck members.

A wall vent is disclosed in U.S. Pat. No. 5,444,947 for incorporation into a foundation wall with the vent having interengageable inner and outer members which may be joined in a manner enabling the vent to be adjusted to suit one or two thickness of the wall under construction. No provision is made for infinite adjustment of the wall vent.

SUMMARY OF THE PRESENT INVENTION

The present invention is embodied within a window buck for installation in a concrete wall being formed with the buck readily assembled using angular connectors in external channels.

A window buck is provided, in one form, for use in forming window openings in walls of various thicknesses with the buck having members each with front and rear components slidably adjustable relative one another. Laterally open channels or grooves formed in the buck members receive connectors placed therein to join the members. The connectors may be of rebar material and reusable if so desired. A yieldable lip on each channel ensures retention of a connector.

Objectives include the provision of a window buck of extruded synthetic material with the buck members assembled into a framework using low cost, reusable connectors set into place in open sided channels; the provision of a window buck for use in walls of a wide range of thicknesses with the buck having, in one form, a central component adding to the range of adjustment of the buck for such thicknesses; the provision of a window buck having a bottom member which is positionable on a wall under construction permitting the discharge of fluid wall material into that area of the wall under the window buck; the provision of a window buck having connectors retaining the buck in a configuration for later reception of a window with one of said connectors serving as a pivot for a bottom member of the buck permitting outward positioning of the bottom member to allow discharge of fluid wall material into that wall area below the buck.

DETAILED DESCRIPTION OF THE PREFERRED EMBODIMENTS

Figure 1:
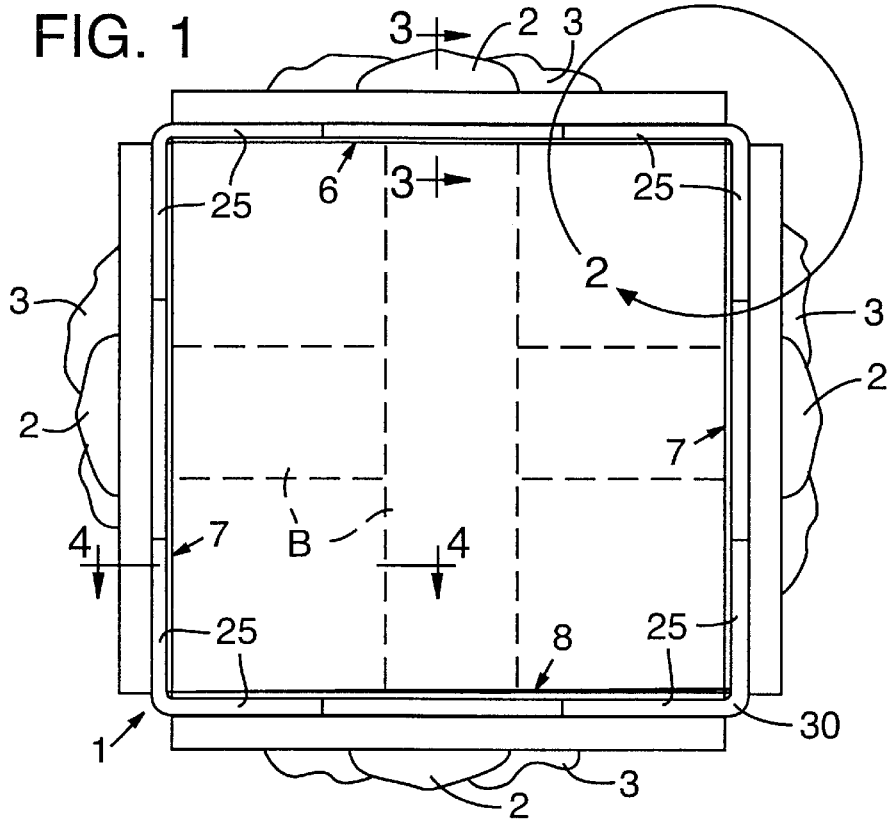
FIG. 1 is a front elevational view of the present window buck with building wall fragments.

With continuing attention to the drawings wherein applied reference numerals indicate parts similarly hereinafter identified, the reference numeral 1 indicates generally the present buck installed within a wall structure of a building under construction having a front wall 2 and a rear wall 3. The present window buck when installed serves to block out an area in a cast wall having a central mass of concrete 4 intermediate front wall member 2 and rear wall member 3 which preferably are of foam construction to provide insulative qualities to the wall as well as serving as wall forms during wall construction. The wall members 2 and 3 are retained in a spaced relationship by a bridge at 5 which may be configured to receive reinforcing bar R, termed rebar in the trade. Integral with bridge 5 are molded plastic blocks 5A–5B embedded in the wall members.

With attention now to the present invention, the present window buck 1 may be of rectangular shape in frontal elevation or of other shapes.

Figure 3:
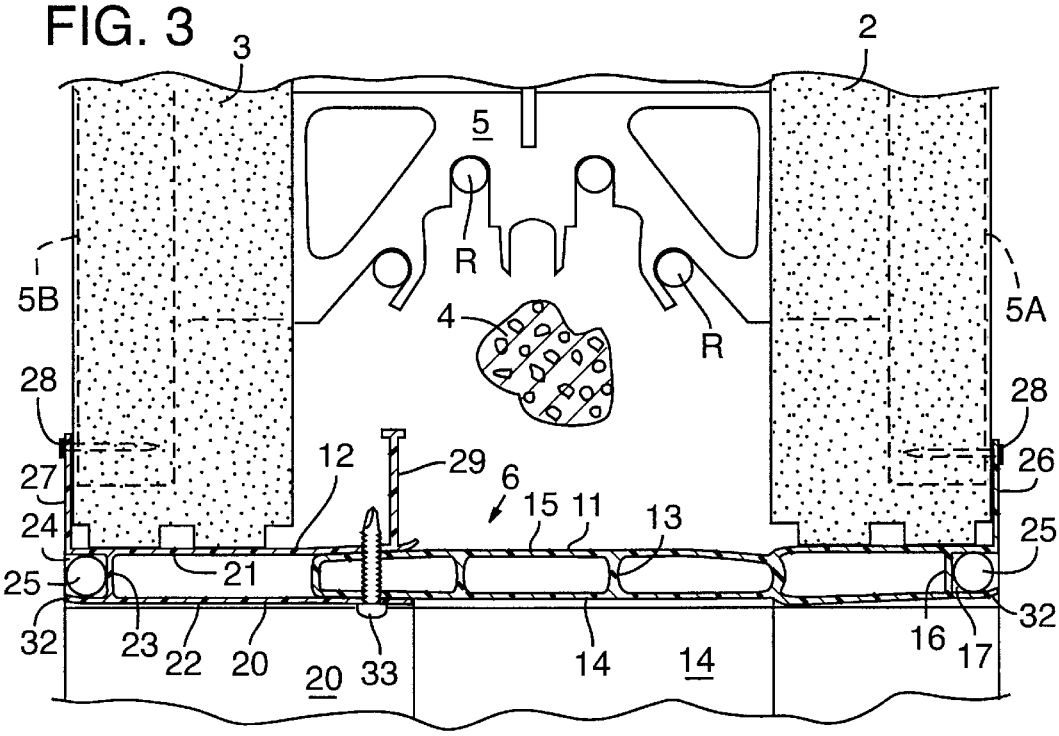
FIG. 3 is a vertical sectional view taken along line 3—3 of FIG. 1.

In FIG. 3, a cross section is shown of a buck top member generally at 6 which cross section is representative of side and bottom members of the window buck and accordingly the following description of buck top member 6 is applicable to side members generally at 7 and bottom member generally at 8. Top member 6 as best shown in FIG. 3, preferably comprises a front component 11 and a rear component 12 with respect to front and rear building walls 2 and 3. Front component 11 is of hollow construction having webs as at 13 extending lengthwise of the component. An inner wall 14 of the component terminates, along with an outer wall 15, at a frontal edge of component 6 and, along with a web 16, defines a laterally open channel 17.

Figure 2:
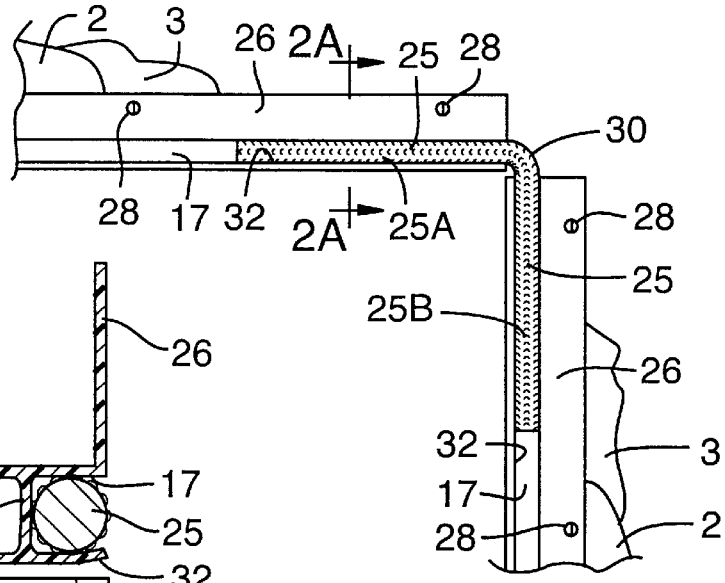
FIG. 2 is an enlarged fragmentary view of that portion of the window buck encircled at 2 in FIG. 1.
Figure 2A:
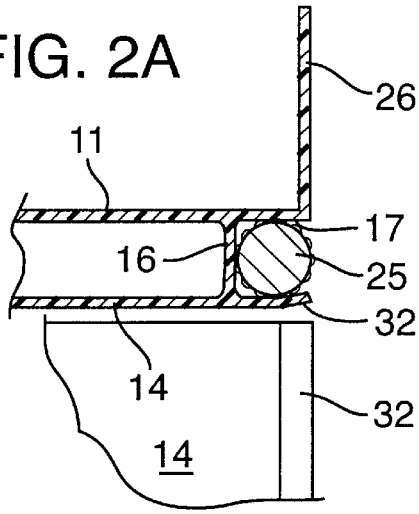
FIG. 2A is a vertical sectional view taken along line 2A—2A of FIG. 2.

A rear component 20 of the window buck includes spaced apart outer and inner walls 21 and 22 which terminate at the rear of the buck, to define, along with a web 23, a laterally open channel 24. Channels 17 and 24 are coterminous with their respective front and rear buck components to receive connectors at 25 having arms 25A–25B and bent at 30, as shown in FIG. 2. A snug fit between channel defining walls and connector arms is desirable to ensure connector retention with the fit enhanced by means of flexible lips at 32 canted toward the channel. When the connectors 25 are formed from reinforcing bar, (rebar), the channels 17 and 24, dimensioned to provide a snug fit, the somewhat irregular external surface of the rebar contributes to such retention. A wall at 29 on rear component 12 projects into concrete 4 to support the mid-portion of an installed buck member.

The outer walls 15 and 21 of components 11 and 12 terminate respectively forwardly and rearwardly in outwardly projecting flanges 26 and 27 enabling securement to external front and rear walls 2 and 3 as by screws 28. The components 11 and 12 are in tongue and groove engagement at their joined edges.

Figure 4:
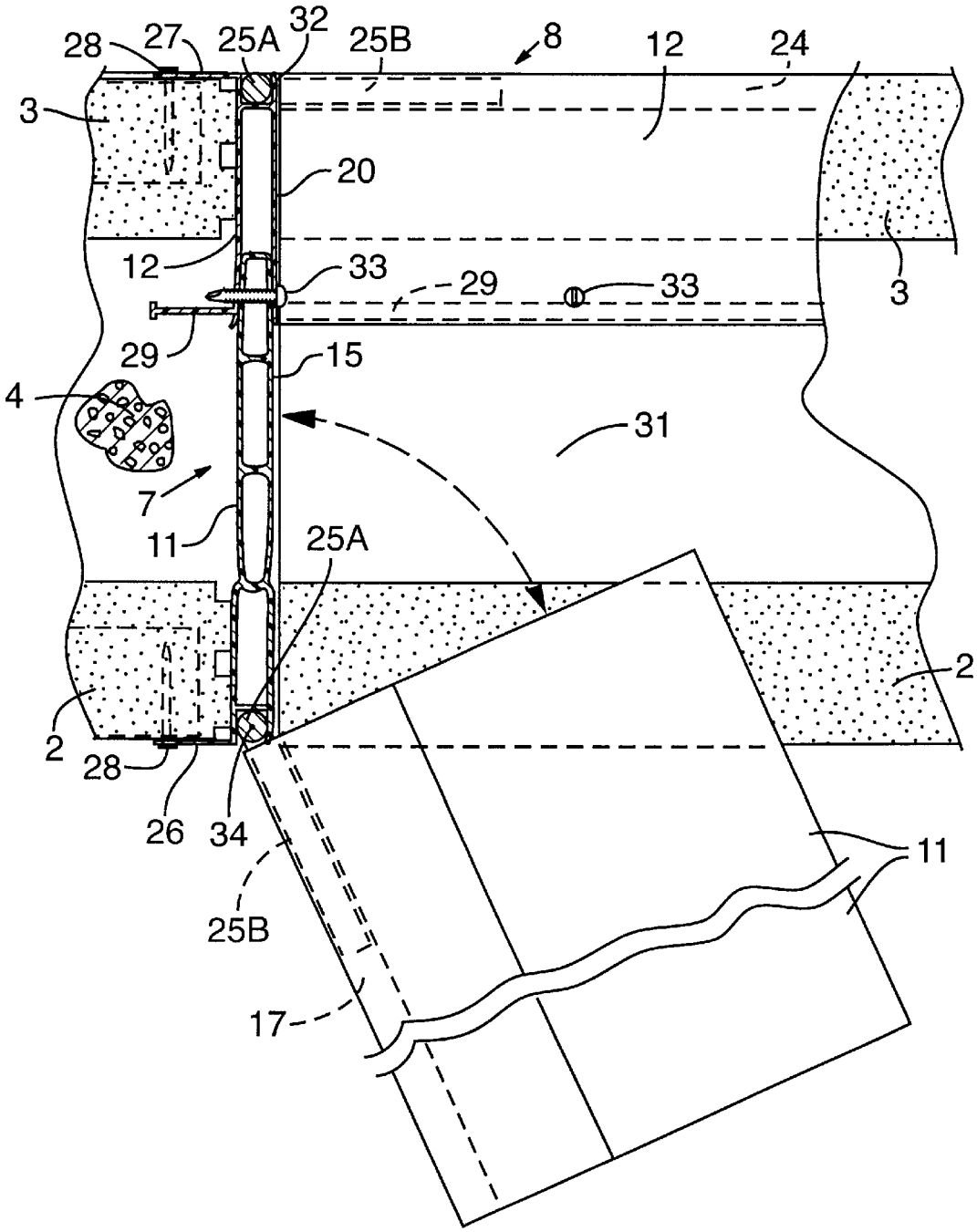
FIG. 4 is a horizontal sectional view taken along line 4—4 of FIG. 1.

With attention to FIG. 4, a side member generally at 7 is shown in section while a bottom member generally at 8 is shown in fragmentary fashion with a front component swung to an open position as later explained. The reference numerals indicated above in the description of the buck top member are applicable to side member 7 and bottom member 8. FIG. 4 best illustrates the feature of the present buck which permits the direct discharge of concrete into an area at 31 directly below the bottom buck member 8 and partially defined by spaced apart front and rear building walls 2 and 3. Subsequent to installation of the window buck on walls 2 and 3, using fasteners 28 passing through buck flanges 26–27, locking screws as at 33 are removed from inserted engagement with bottom buck member components 11 and 12. Upon removal of fastener 33, front buck component 11 may be swung about an axis 34 of an arm 25A of a connector 25. The remaining arm 25B of the connector remains in laterally open channel 17 of front member 11 to support same during arcuate opening of bottom front member 11 as shown in full lines. Heretofore, in existing window bucks, filly charging the area below a buck in a wall under construction constituted a problem solved with time consuming manual effort. Upon filling of area 31 with concrete, bottom front member 11 of the bottom buck member 8 is swung back into place in inserted engagement with bottom rear member 12 of the buck and locking screws 33 are re-inserted. Screws 33 are preferably self tapping to facilitate locking of the front and rear components 11 and 12 of a buck after the components have been adjusted relative one another to accommodate the width of the wall under construction.

Figure 5:
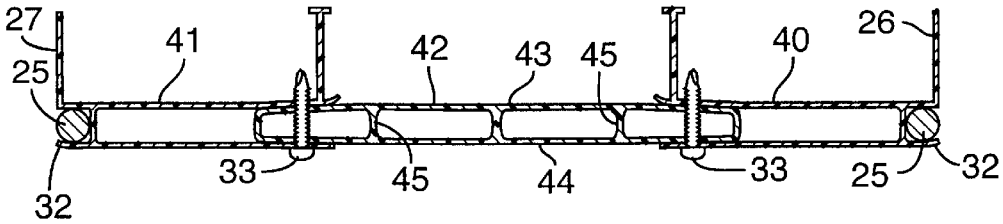
FIG. 5 is a vertical sectional view of a buck member of a modified window buck.

In FIG. 5, a modified window buck member is shown in cross section wherein front and rear buck components at 40—41 are joined by a center component 42 of tubular or hollow construction with spaced apart walls 43–44 reinforced by webs 45. Rear component 41 would be similar to earlier described rear component 12, while front component 40 would be, in cross section, a mirror image of rear component 12. Locking fasteners at 33 are seated upon lateral adjustment of front and rear components 40–41 on the center component to accommodate the extraordinary thickness of the wall under construction.

Figure 6:
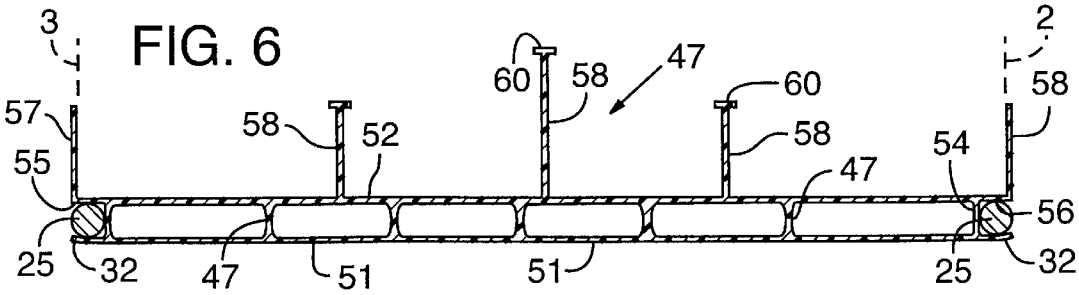
FIG. 6 is a vertical sectional view of a buck member of a still further modified window buck.

In FIG. 6 a unitary or one piece buck member is shown generally at 46 and is for use in a wall construction where wall thickness of several concrete walls will be to a fixed or standard dimension. The cross section shown is of a top member and is also typical of the side and bottom buck members of the modified buck except as disclosed below. Inner and outer walls are at 51 and 52 both terminate endwise in flanges 57 and 59. Walls 51–52 define, along with webs 53 and 54, laterally open channels 55 and 56 in which connectors 25 are received. Reinforcing webs are shown at 47. Walls at 59 project from outer wall 52 and have a head 60 thereon for embedment in poured concrete. Upon setting of the concrete the walls retain the mid-portion of buck member 47 in place.

A still further modified window buck would comprise top and side buck members having a cross section as viewed in FIG. 6. To achieve the desirable feature enabling changing of a form defined area below a bottom buck member, the bottom buck member would be of two piece construction as shown in FIGS. 3 and 4 but, of course, inverted from that shown. Front buck component 11 would swing about the axis of a connector arm to provide access permitting the deposit of concrete below the window buck followed by re-positioning of component 11 and re-installation of the temporarily detached connector arm 25 in channel 17 of repositioned buck component 11.

In use of the present buck invention, a building wall is partially completed up to the level whereat the wall provides partial walls 2 and 3 including rebar R therefor.

Window buck members are assembled to accommodate wall thickness by positioning of buck member components 11 and 12 and the insertion of locking screws 33 therethrough. With the buck members lying in place on their flanges 26 on a hard flat surface, the members are positioned in a rectangular or other polygonal shape desired with the ends of the top, side and bottom members 6, 7 and 8 in intersecting orientation to receive arms 25A–26A of connectors 25. For installation of the connector arms into intersecting or converging channels 17 and 24, a connector 25 is placed on two channels with the connector bend 30 therebetween. An impact tool such as a mallet or hammer is utilized to seat each connector arm in its respective channel. Upon installation of the connectors on one side of buck (presently lying on its side) the buck is turned over and the remaining side provided with the requisite number of connectors. The assembled buck is subsequently placed on the partially completed building wall and attached thereto by fasteners 28 inserted through buck flanges 26, 27 of bottom buck member 8. Thereafter the building walls 2 and 3 are completed with the remaining buck members 7 and top member 6 being attached to walls 2 and 3 by fasteners 28

The window buck is braced at B prior to pouring of concrete with the bracing removed upon setting of the concrete.

While we have shown but a few embodiments of the invention, it will be apparent to those skilled in the art that the invention may be embodied still otherwise without departing from the spirit and scope of the claimed invention.

We claim:

1. A window buck, comprising:

a plurality of elongate buck members that are adapted to collectively define an opening in a wall that is at least partially formed from concrete and has a thickness bounded by front and rear wall surfaces, wherein each buck member has a width that is adapted to span the distance between the front and rear wall surfaces and a length that is adapted to extend generally along the opening in the wall in a direction transverse to the width of the wall to define a lengthwise axis of the buck member, wherein each buck member includes a pair of laterally open channels that are open in a direction generally normal to the lengthwise axis of the member, with the laterally open channels each extending generally parallel to a respective one of the wall surfaces, and further wherein the laterally open channels of each buck member include openings that are externally accessible when the plurality of buck members are assembled together to define the opening.

2. The buck of claim 1, wherein the laterally open channels of each buck member are open in directions that are at least generally opposed to each other.

3. The buck of claim 1, wherein the buck further includes a plurality of connectors that are adapted to secure the plurality of members in a selected configuration, and further wherein each connector includes a first region that is adapted to extend into a channel of a first one of the plurality of members and a second region that is adapted to extend into a channel of a second one of the plurality of members.

4. The buck of claim 3, wherein the laterally open channels have generally rectilinear cross-sectional configurations and the connectors have generally circular configurations that permit rotation of an inserted region of one of the connectors within one of the laterally open channels.

5. The buck of claim 3, wherein each laterally open channel includes a lip that is adapted to retain an inserted region of one of the connectors within the channel.

6. The buck of claim 5, wherein the lip is a yieldable lip and thereby adapted to deflect away from the laterally open channel as a region of one of the connectors is inserted into the channel and then return toward the channel after the region has been inserted into the channel.

7. The buck of claim 5, wherein the lip is canted into the channel.

8. The buck of claim 1, wherein each buck member includes flanges that are sized to extend at least partially along the wall surfaces.

9. The buck of claim 1, wherein the buck members are integrally formed one-piece members.

10. The buck of claim 1, wherein each of the buck members further includes at least one laterally closed channel that is closed in directions measured transverse to the lengthwise axis of the member.

11. The buck of claim 1, wherein each buck member includes a body that includes at least a first component, which includes one of the laterally open channels, and a second component, which includes the other of the laterally open channels, and further wherein the first and the second components are adapted to be releasably secured together.

12. The buck of claim 11, wherein the first and the second components are releasably and adjustably secured together.

13. The buck of claim 11, wherein each buck member includes at least one releasable fastener that is adapted to selectively secure the first and the second components of the buck member together.

14. The buck of claim 11, further comprising a connector extending into the laterally open channel of a component of a pair of the plurality of buck members to provide a pivotal connection between the components and thereby provide an axis about which one of the components may be selectively pivoted away from the wall opening and returned thereto.

15. The buck of claim 14, wherein each of the connectors has a generally circular cross-sectional configuration to permit rotation of an inserted region of one of the connectors within one of the laterally open channels.

16. The buck of claim 11, wherein at least one of the components further includes at least one laterally closed channel that is closed in directions measured transverse to the lengthwise axis of the member, and further wherein at least one of the components does not include such a laterally closed internal channel.

17. A window buck, comprising:

a plurality of elongate buck members that are adapted to collectively define an opening in a wall that is at least partially formed from concrete and has a thickness bounded by front and rear wall surfaces, wherein each buck member has a width that is adapted to span the distance between the front and rear wall surfaces and a length that is adapted to extend generally along the opening in the wall in a direction transverse to the width of the wall to define a lengthwise axis of the buck member, wherein each buck member includes a pair of generally opposed ends and when the buck is assembled, the ends of adjacent ones of the plurality of buck members extend at least proximate to each other, and further wherein each buck member includes a pair of laterally open channels that define an opening extending between the ends and along a side region of the buck member; and a plurality of connectors, wherein each connector includes a first region that is adapted to be inserted into a laterally open channel of a first one of the plurality of buck members and a second region that is adapted to be inserted into a laterally open channel of a second one of the plurality of buck members to retain the first and the second ones of the plurality of buck members together, and further wherein when the buck member is assembled, the connectors are externally accessible and adapted to be selectively removed from and replaced into the channels while the buck member is assembled.

18. The buck of claim 17, wherein each buck member includes a body that includes at least a first component, which includes one of the laterally open channels, and a second component, which includes the other of the laterally open channels, and further wherein the first and the second components are adapted to be adjustably secured together to enable the width of the buck member to be selectively adjusted.

19. The buck of claim 18, wherein each buck member includes at least one releasable fastener that is adapted to selectively secure the first and the second components of the buck member together.

20. The buck of claim 19, wherein each of the releasable fasteners are adapted to be removably inserted through the first and the second components.

21. The buck of claim 18, further comprising a connector extending into the laterally open channel of a component of a pair of the plurality of buck members to provide a pivotal connection between the components and thereby provide an axis about which one of the components may be selectively pivoted away from the wall opening and returned thereto.

22. The buck of claim 21, wherein each of the connectors has a generally circular cross-sectional configuration to permit rotation of an inserted region of one of the connectors within one of the laterally open channels.

23. A window buck, comprising:

a plurality of elongate buck members that are adapted to collectively define an opening in a wall that is at least partially formed from concrete and has a thickness bounded by front and rear wall surfaces, wherein each buck member has a width that is adapted to span the distance between the front and rear wall surfaces and a length that is adapted to extend generally along the opening in the wall in a direction transverse to the width of the wall to define a lengthwise axis of the buck member, and further wherein each buck member includes a pair of laterally open channels that are open in a direction generally normal to the lengthwise axis of the member, with the laterally open channels each extending generally parallel to a respective one of the wall surfaces; and a plurality of connectors that are adapted to secure the plurality of members in a selected configuration, wherein each connector includes a first region that is adapted to extend into a channel of a first one of the plurality of members and a second region that is adapted to extend into a channel of a second one of the plurality of members, and further wherein the laterally open channels have generally rectilinear cross-sectional configurations and the connectors have generally circular configurations that permit rotation of an inserted region of one of the connectors within one of the laterally open channels.

24. The buck of claim 23, wherein each laterally open channel includes a lip that is adapted to retain an inserted region of one of the connectors within the channel.

25. The buck of claim 24, wherein the lip is a yieldable lip and thereby adapted to deflect away from the laterally open channel as a region of one of the connectors is inserted into the channel and then return toward the channel after the region has been inserted into the channel.

26. The buck of claim 24, wherein the lip is canted into the channel.

27. The buck of claim 23, wherein each buck member includes flanges that are sized to extend at least partially along the wall surfaces.

28. The buck of claim 23, wherein the buck members are integrally formed one-piece members.

29. The buck of claim 23, wherein each of the buck members further includes at least one laterally closed channel that is closed in directions measured transverse to the lengthwise axis of the member.

30. The buck of claim 23, wherein the laterally open channels of each buck member are open in directions that are at least generally opposed to each other.

31. A window buck, comprising:

a plurality of elongate buck members that are adapted to collectively define an opening in a wall that is at least partially formed from concrete and has a thickness bounded by front and rear wall surfaces, wherein each buck member has a width that is adapted to span the distance between the front and rear wall surfaces and a length that is adapted to extend generally along the opening in the wall in a direction transverse to the width of the wall to define a lengthwise axis of the buck member, wherein each buck member includes a pair of laterally open channels that are open in a direction generally normal to the lengthwise axis of the member, with the laterally open channels each extending generally parallel to a respective one of the wall surfaces, wherein each buck member includes a body that includes at least a first component, which includes one of the laterally open channels, and a second component, which includes the other of the laterally open channels, and further wherein the first and the second components are adapted to be releasably secured together; and a connector extending into the laterally open channel of a component of a pair of the plurality of buck members to provide a pivotal connection between the components and thereby provide an axis about which one of the components may be selectively pivoted away from the wall opening and returned thereto.

32. The buck of claim 31, wherein each of the connectors has a generally circular cross-sectional configuration to permit rotation of an inserted region of one of the connectors within one of the laterally open channels.

33. The buck of claim 31, wherein the first and the second components are releasably and adjustably secured together.

34. The buck of claim 31, wherein each buck member includes at least one releasable fastener that is adapted to selectively secure the first and the second components of the buck member together.

35. The buck of claim 31, wherein at least one of the components further includes at least one laterally closed channel that is closed in directions measured transverse to the lengthwise axis of the member, and further wherein at least one of the components does not include such a laterally closed internal channel.

36. A window buck, comprising:

a plurality of elongate buck members that are adapted to collectively define an opening in a wall that is at least partially formed from concrete and has a thickness bounded by front and rear wall surfaces, wherein each buck member has a width that is adapted to span the distance between the front and rear wall surfaces and a length that is adapted to extend generally along the opening in the wall in a direction transverse to the width of the wall to define a lengthwise axis of the buck member, wherein each buck member includes a pair of laterally open channels that are open in a direction generally normal to the lengthwise axis of the member, with the laterally open channels each extending generally parallel to a respective one of the wall surfaces, wherein each buck member includes a body that includes at least a first component, which includes one of the laterally open channels, and a second component, which includes the other of the laterally open channels, wherein the first and the second components are adapted to be releasably and adjustably secured together, and further wherein each buck member includes at least one releasable fastener that is adapted to selectively secure the first and the second components of the buck member together.

37. The buck of claim 36, wherein at least one of the components further includes at least one laterally closed channel that is closed in directions measured transverse to the lengthwise axis of the member, and further wherein at least one of the components does not include such a laterally closed internal channel.

38. The buck of claim 36, wherein the laterally open channels of each buck member are open in directions that are at least generally opposed to each other.

39. The buck of claim 36, wherein the buck further includes a plurality of connectors that are adapted to secure the plurality of members in a selected configuration.

40. The buck of claim 39, wherein each connector includes a first region that is adapted to extend into a channel of a first one of the plurality of members and a second region that is adapted to extend into a channel of a second one of the plurality of members.

41. The buck of claim 40, wherein the laterally open channels have generally rectilinear cross-sectional configurations and the connectors have generally circular configurations that permit rotation of an inserted region of one of the connectors within one of the laterally open channels.

42. The buck of claim 40, wherein each laterally open channel includes a lip that is adapted to retain an inserted region of one of the connectors within the channel.

43. The buck of claim 42, wherein the lip is a yieldable lip and thereby adapted to deflect away from the laterally open channel as a region of one of the connectors is inserted into the channel and then return toward the channel after the region has been inserted into the channel.

44. The buck of claim 42, wherein the lip is canted into the channel.

45. The buck of claim 36, wherein the first and the second components each includes a flange that is sized to extend at least partially along a respective one of the wall surfaces.

* * * * *